US006299046B1

(12) United States Patent
Chen

(10) Patent No.: US 6,299,046 B1
(45) Date of Patent: Oct. 9, 2001

(54) NAILING GUN STRUCTURE

(76) Inventor: Cheng-Chung Chen, No. 110, Yi-Hsin 2nd Road, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/788,466

(22) Filed: Feb. 21, 2001

(51) Int. Cl.[7] ..... B25C 1/04
(52) U.S. Cl. ..... 227/109; 227/120
(58) Field of Search ..... 227/109, 120, 227/135, 136, 119, 156

(56) References Cited

U.S. PATENT DOCUMENTS 4,519,533 * 5/1985 Jirovetz ..... 227/120
4,728,021 * 3/1988 Kennedy ..... 227/156
5,522,533 * 6/1996 Mukoyama et al. ..... 227/109
5,626,274 * 5/1997 Shkolnikove et al. ..... 227/120
5,704,532 * 1/1998 Wey ..... 227/109
6,161,746 * 12/2000 Wey ..... 227/109

* cited by examiner

*Primary Examiner*—Scott A. Smith
(74) *Attorney, Agent, or Firm*—Rosenberg, Klein & Lee

(57) ABSTRACT

A nailing gun structure including a gun body and a nail magazine. The gun body has a head section having a downward extending frame body. The nail magazine is disposed in the frame body and formed with multiple parallel nail channels with different types. The nail magazine is transversely movable to aim any of the nail channels at an inlet of the head section of the gun body. One end of each nail channel is formed with a passage through which a nail-pushing plate can be upward pushed into the nail channel for pushing the rows of nails received in the nail channels. The nail-pushing plate is driven by a driving unit disposed on the frame body to reciprocally move on the frame body so as to push different rows of nails in the nail channels into the head section of the gun body.

5 Claims, 4 Drawing Sheets

NAILING GUN STRUCTURE

BACKGROUND OF THE INVENTION

The present invention is related to an improved nailing gun structure in which the nail magazine is formed with multiple parallel nail channels with different types. A nail-pushing plate is driven by a driving unit to move into any of the nail channels so as to push different rows of nails into a head section of the gun body. The operation of the nailing gun is simple and the different rows of nails can be conveniently replaced.

FIG. 6 shows a conventional nailing gun having a main body 8 and a head section 81 disposed at front end of the main body 8. A nail magazine 82 is inserted in the head section 81. A row of nails 83 are received in a nail channel (not shown) of the nail magazine 82. Two springs 84 are disposed in the nail channel for pushing a nail-pushing plate 85 which pushes the row of nails 83 into the head section 81 for use.

In such conventional nailing gun, the nail magazine 82 has only one nail channel. Therefore, the nail magazine 82 can be loaded with only a row of nails 83 of one kind

SUMMARY OF THE INVENTION

It is therefore a primary object of the present invention to provide an improved nailing gun structure including a nail magazine formed with multiple parallel nail channels with different types. The nail channels can receive therein multiple rows of different types of nails. The nail magazine is formed with tenons which are transversely movable in corresponding mortises of a frame body, whereby any of the nail channels can be aimed at an inlet of the head section of the gun body. A nail-pushing plate is driven by a driving unit disposed on the frame body to reciprocally move on the frame body. One end of each nail channel is formed with a passage through which the nail-pushing plate can be pushed into the nail channels for pushing different rows of nails in the nail channels into the head section of the gun body. The operation of the nailing gun is simple and the different rows of nails can be conveniently replaced.

The present invention can be best understood through the following description and accompanying drawings wherein:

DETAILED DESCRIPTION OF THE PREFERRED EMBODIMENT

Figure 1:
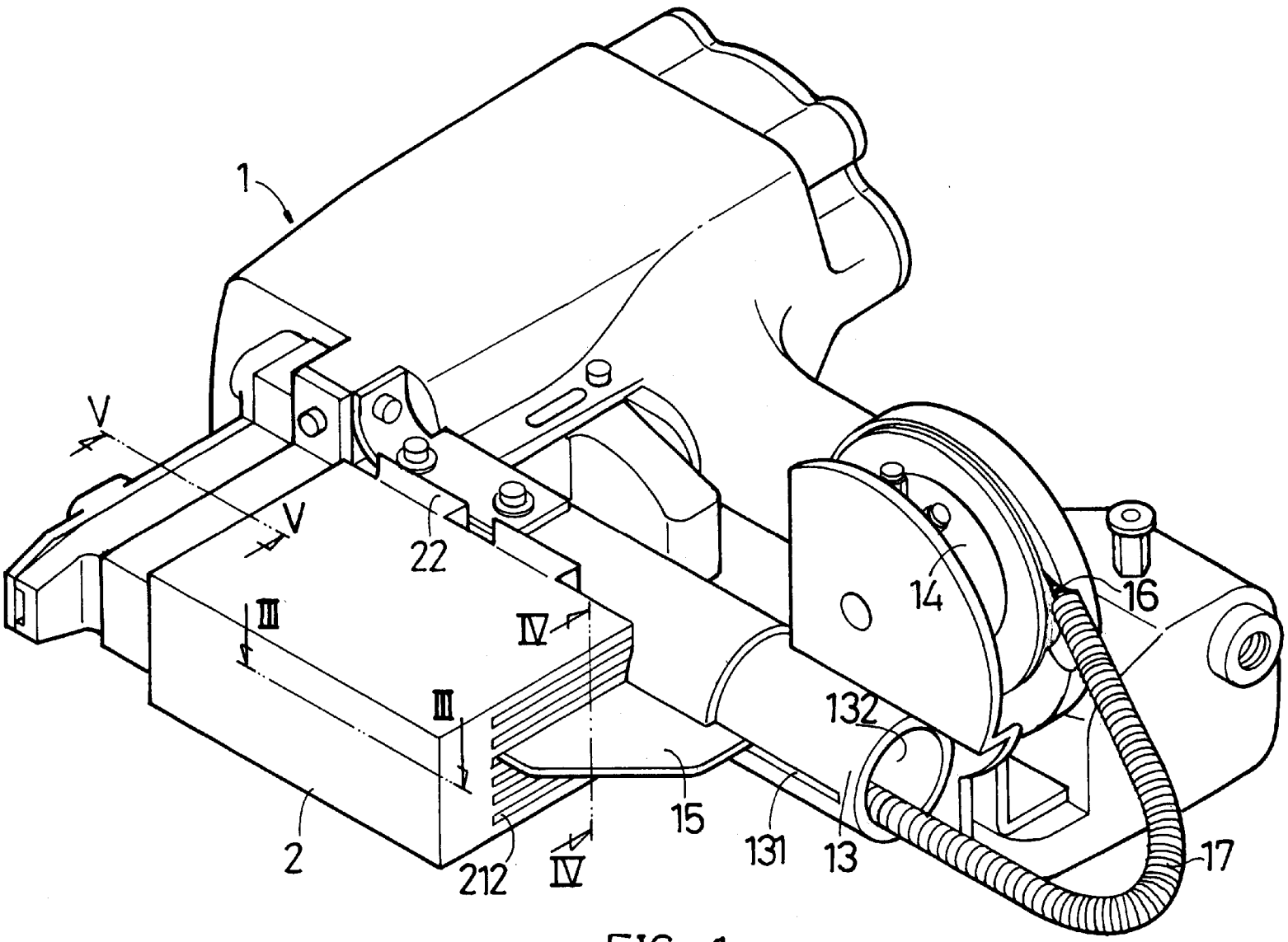
FIG. 1 is a perspective assembled view of the present invention.
Figure 2:
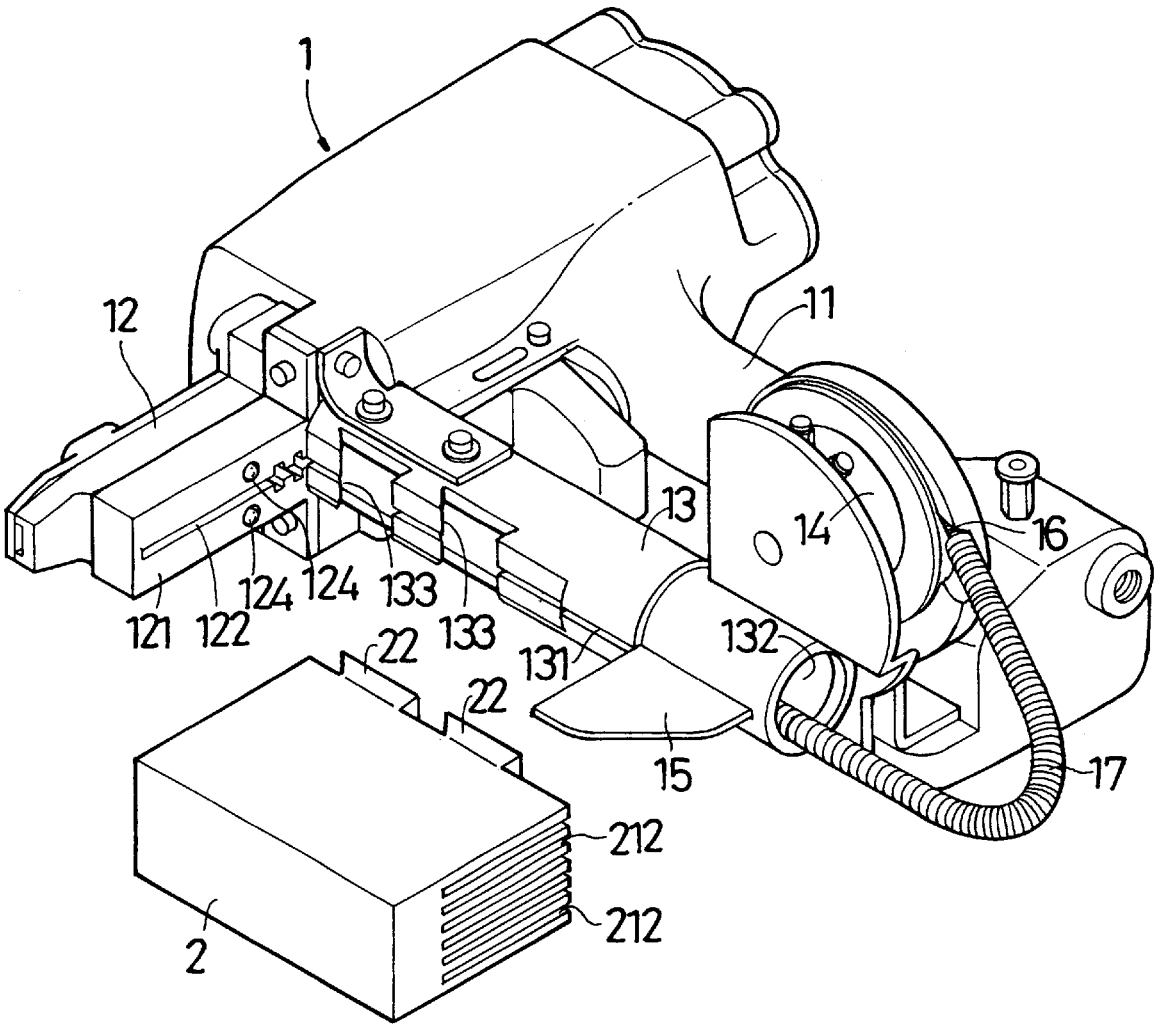
FIG. 2 is a perspective exploded view of the present invention.
Figure 3:
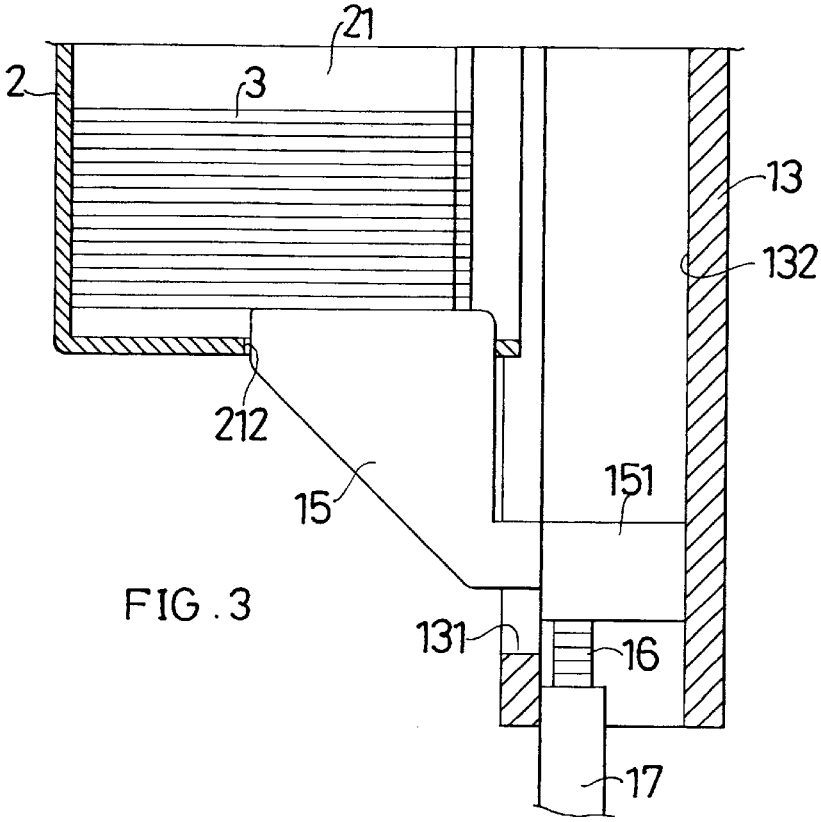
FIG. 3 is a sectional view taken along line III—III of FIG. 1.
Figure 4:
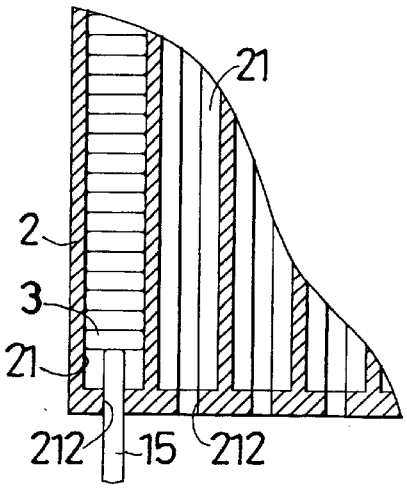
FIG. 4 is a sectional view taken along line IV—IV of FIG. 1.
Figure 5:
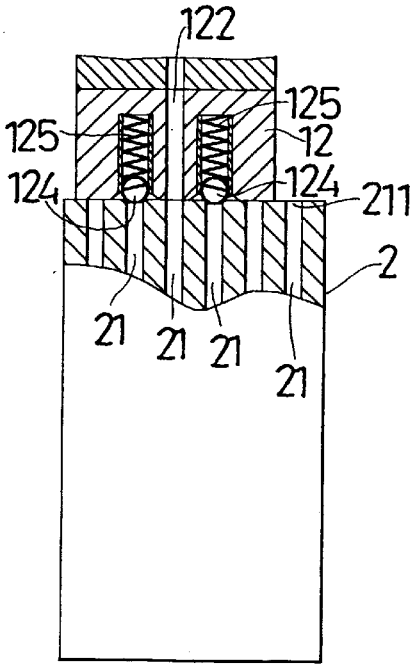
FIG. 5 is a sectional view taken along line V—V of FIG. 1.
Figure 6:
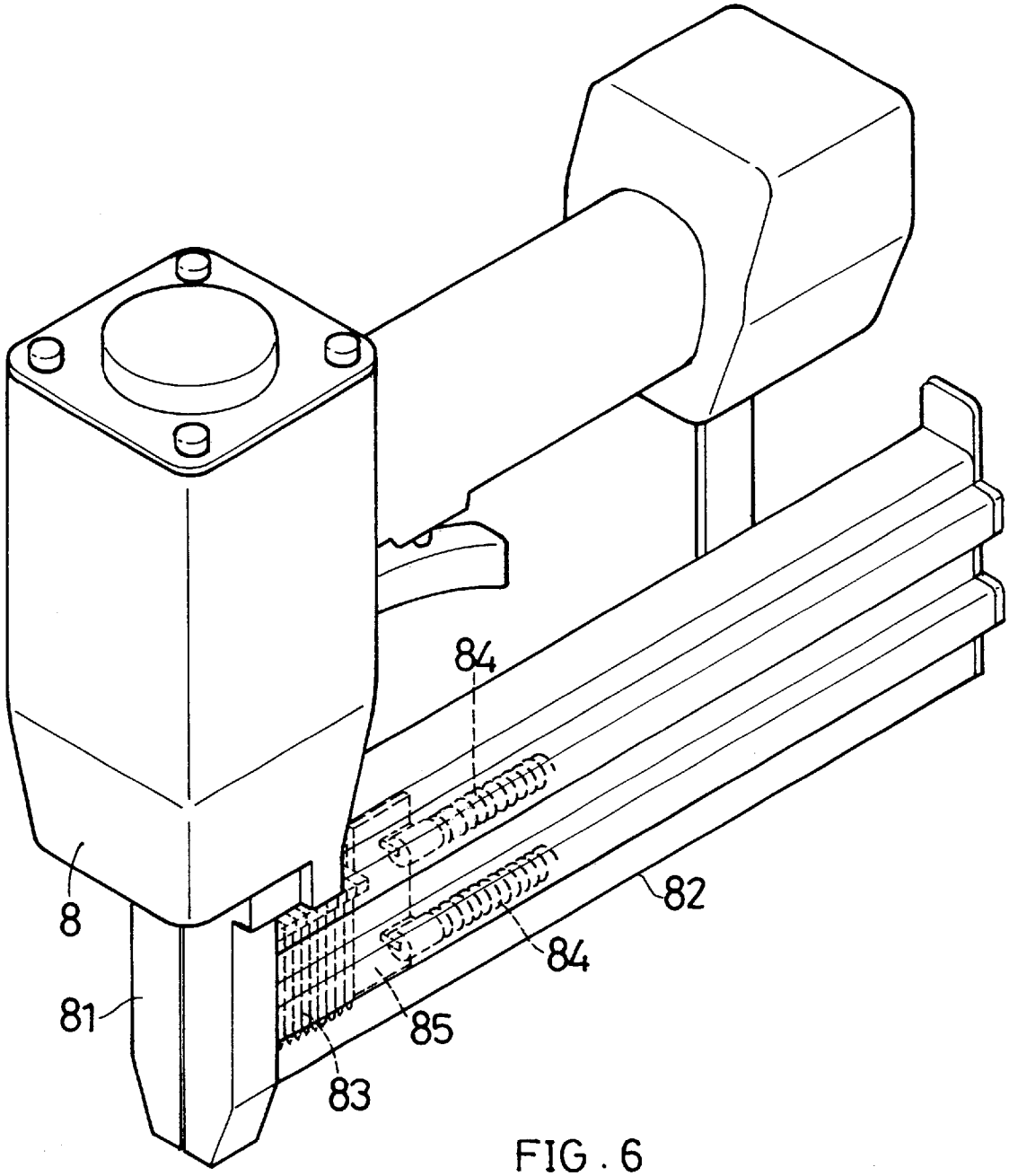
FIG. 6 PRIOR ART
FIG. 6 is a perspective view of a conventional nailing gun.

Please refer to FIGS. 1 to 5. The nailing gun structure of the present invention includes a gun body 1 and a nail magazine 2.

The gun body 1 has a handle section 11 and a head section 12. The head section 12 has a downward extending frame body 13 provided with a revolving cylinder 14. The frame body 13 is formed with a slide slot 131 downward extending from the head section 12. A nail-pushing plate 15 is slidably disposed in the frame body 13. The nail-pushing plate 15 extends through the slide slot 131 out of the frame body 13. A slide rail 132 is disposed in the frame body 13. The nail-pushing plate 15 has a seat section 151 having a shape complementary to that of the slide rail 132. The seat section 151 is slidable within the slide rail 132. The revolving cylinder 14 is connected with the nail-pushing plate 15 by a flexible steel cord 16. A conduit 17 is disposed between the revolving cylinder 14 and the frame body 13 for the steel cord 16 to pass therethrough. Via the steel cord 16, the revolving cylinder 14 can drive the nail-pushing plate 15 to reciprocally move along the slide slot 131 of the frame body 13. The head section 12 has a bottom face 121 formed with an inlet 122.

The nail magazine 2 is formed with multiple longitudinally extending nail channels 21 which are parallel to each other and have different patterns. One end of each nail channel 21 extends out of the nail magazine 2 to form an opening 211. Through the opening 211, different types and lengths of rows of nails 3 can be loaded into the nail channels 21. One side of the nail magazine 2 near the frame body 13 is provided with two dovetail tenons 22. The frame body 13 is formed with two transversely extending dovetail mortises 133 corresponding to the dovetail tenons 22. By means of transversely inserting the dovetail tenons 22 into the dovetail mortises 133, the nail magazine 2 can be connected with the frame body 13 and transversely moved within the dovetail mortises 133. The end of each nail channel 21 opposite to the opening 211 is formed with a passage 212 through which the nail-pushing plate 15 can be upward pushed into the nail channel 21 for pushing the row of nails 3. The nail-pushing plate 15 can respectively push the rows of nails 3 in the nail channels 21 into the head section 12 of the gun body 1. The cross-section of the passage 212 is smaller than that of the nail channel 21, so that the rows of nails 3 are received in the nail channels 21 without dropping out from the passage 212.

Two sides of the inlet 122 of the head section 12 are respectively formed with two holes 123. A locating steel ball 124 and a spring 125 are embedded in each hole 123. The spring 125 serves to push the steel ball 124 to protrude from the bottom face 121 of the head section 12. The distance between the inlet 122 and the two locating steel balls 124 is equal to the distance between two adjacent nail channels 21. Accordingly, when any of the nail channels 21 is aimed at the inlet 122 of the head section 12, at least one of the two locating steel balls 124 is inlaid and retained in the nail channel 21 adjacent to the nail channel 21 aimed at the inlet 122 so as to locate the nail magazine 2.

The nail-pushing plate 15 is driven by the revolving cylinder 14 via the steel cord 16 to move on the frame body 13. Prior to installation of the nail magazine 2, the revolving cylinder 14 is switched to drive the nail-pushing plate 15 to a lowest position of the slide slot 131. At this time, the nail magazine 2 can be loaded into the frame body 13 from one side thereof. The dovetail tenons 22 of the nail magazine 2 are inserted into the dovetail mortises 133, whereby the nail magazine 2 can be transversely moved within the dovetail mortises 133. The nail magazine 2 has multiple nail channels 21 in which multiple rows of different nails 3 are loaded. Accordingly, as necessary, a user can transversely move the nail magazine 2 to aim the nail channel 21 in which the nails 3 are loaded at the inlet 122 of the head section 12. At this time, the locating steel ball 124 of the head section 12 is retained in the opening 211 of the adjacent nail channel 21 to locate the nail magazine 2. Then, the user can switch the revolving cylinder 14 to drive the nail-pushing plate 15 to move upward along the slide slot 131. At this time, the nail-pushing plate 15 can move from the passage 212 into the nail channel 21 to push the nails 3 from the inlet 122 into the head section 12 for nailing operation. When using different nails 3, the user can first switch the revolving cylinder 14 to drive the nail-pushing plate 15 to move to the lowest position of the slide slot 131. At this time, the nail magazine 2 can be transversely moved to select the necessary nails 3. Thereafter, the revolving cylinder 14 is switched to drive the nail-pushing plate 15 to push the nails 3 into the head section 12 for nailing operation. Accordingly, it is unnecessary to detach the nail magazine and take out the row of nails for replacement.

In conclusion, the nail magazine 2 of the present invention has multiple parallel nail channels 21 in which multiple rows of different nails 3 are received. The dovetail tenons 22 of the nail magazine 2 can be transversely moved within the dovetail mortises 133 of the frame body 13, whereby any of the nail channels 21 can be aimed at the inlet 122 of drive head section 12 of the gun body 1. The revolving cylinder 14 can drive the nail-pushing plate 15 to reciprocally move along the slide slot 131 of the frame body 13. Each nail channel 21 is formed with a passage 212 through which the nail-pushing plate 15 can be pushed into the nail channel 21 for pushing the row of nails 3 into the head section 12 of the gun body 1.

The above embodiment is only used to illustrate the present invention, not intended to limit the scope thereof. Many modifications of the above embodiment can be made without departing from the spirit of the present invention.

What is claimed is:

1. A nailing gun structure comprising:

a gun body having a handle section and a head section, the head section having a downward extending frame body provided with a driving unit, a nail-pushing plate being driven by the driving unit and reciprocally movable on the frame body; and a nail magazine formed with multiple parallel nail channels which have different patterns for receiving therein different types of rows of nails, each nail channel having an opening extending out of the nail magazine, one end of each nail channel opposite to the opening being formed with a passage through which the nail-pushing plate can be upward pushed into the nail channel for pushing the row of nails, one side of the nail magazine near the frame body being provided with more than one tenon, the frame body being formed with more than one transversely extending mortise corresponding to the tenon, the nail magazine being transversely movable within the mortise, whereby the nail-pushing plate can respectively push the rows of nails in the nail channels into the head section of the gun body.

2. A nailing gun structure as claimed in claim 1, wherein the driving unit is a pneumatic revolving cylinder which is connected with the nail-pushing plate by a flexible steel cord, a conduit being disposed between the revolving cylinder and the frame body for the steel cord to pass therethrough, whereby via the steel cord, the revolving cylinder can drive the nail-pushing plate to reciprocally move on the frame body.

3. A nailing gun structure as claimed in claim 1, wherein the frame body is formed with a slide slot in which the nail-pushing plate is disposed and along which the nail-pushing plate is movable.

4. A nailing gun structure as claimed in claim 1, wherein more than one locating steel ball is embedded in the head section of the gun body, the head section being formed with an inlet through which the row of nails are pushed into the head section, whereby when any of the nail channels is aimed at the inlet of the head section, the locating steel ball locates the nail magazine.

5. A nailing gun structure as claimed in claim 4, wherein two sides of the inlet of the head section are respectively provided with two locating steel balls, a distance between the inlet and the two locating steel balls being equal to a distance between two adjacent nail channels, whereby when any of the nail channels is aimed at the inlet of the head section, at least one of the two locating steel balls is inlaid and retained in the nail channel adjacent to the nail channel aimed at the inlet so as to locate the nail magazine.

* * * * *